United States Patent [19]

Korzeb et al.

[11] 4,259,060

[45] Mar. 31, 1981

[54] DISCHARGE END STRUCTURE FOR ROTARY RETORTS

[75] Inventors: Frank Korzeb, Westfield; William I. Bayly, Livingston, both of N.J.

[73] Assignee: AGF Inc., Elizabeth, N.J.

[21] Appl. No.: 84,783

[22] Filed: Oct. 15, 1979

[51] Int. Cl.[3] ..... F27D 1/16; F27B 6/08; F27B 7/32; F27B 7/14

[52] U.S. Cl. ..... 432/3; 432/112; 432/117; 432/118

[58] Field of Search ..... 432/3, 112, 117, 118

[56] References Cited

U.S. PATENT DOCUMENTS

| | | | |
|---|---|---|---|
| 1,656,924 | 1/1928 | Smith | 432/112 |
| 3,441,259 | 4/1969 | Heyer et al. | 432/112 |
| 3,556,498 | 1/1971 | Sheahan | 432/112 |
| 3,836,324 | 9/1974 | Shaefer | 432/112 |
| 3,927,959 | 12/1975 | Mescher et al. | 432/3 |
| 4,025,297 | 5/1977 | Smith et al. | 432/112 |
| 4,069,007 | 1/1978 | Smith et al. | 432/3 |

*Primary Examiner*—John J. Camby

*Attorney, Agent, or Firm*—Lerner, David, Littenberg & Samuel

[57] ABSTRACT

A rotary retort has an open discharge end located within a furnace. An axle assembly extends into the discharge end to support it for rotation in the furnace.

31 Claims, 2 Drawing Figures

DISCHARGE END STRUCTURE FOR ROTARY RETORTS

FIELD OF THE INVENTION

The present invention relates generally to rotary retorts, and, more particularly, to such retorts which have an internal helical flight for conveying workpieces through the retort as it rotates. The workpieces may be heat-treated as they are transported through the retort.

BACKGROUND OF THE INVENTION

For many years, rotary retort furnaces have been used in the heat treatment, e.g., carburizing, carbonitriding, carbon restoration, or hardening of a variety of workpieces, such as screws, nuts, bolts, washers, rivets, pins, balls and springs. Many of the retorts used in these furnaces are provided with an internal helical flight or spiral adapted to transport the workpieces through the retorts as they rotate in the furnace.

In the past, it has been common practice to provide a retort with a pair of bell-shaped ends which may be used as bearing-engaging supports for the retort when the ends are disposed externally of a furnace (see, for example, Sheahan U.S. Pat. No. 3,556,498). Workpieces which have been transported through the retort are discharged through openings provided in the circumferential surface of the retort near one end thereof. Because the number and size of the discharge openings which may be provided in the circumferential surface of the retort are limited, it is difficult to achieve a uniform rate of discharge. Also, the bell-shaped ends are difficult and, therefore, expensive to form, for instance, by casting.

Rotary retorts which have wide-mouth open ends, as compared with bell-shaped ends, can discharge workpieces directly from an end thereof, rather than through discharge openings in the circumferential surface of the retort, and, thus, avoid the two problems or disadvantages discussed above which plague the known retorts having bell-shaped ends. However, problems are encountered in supporting the discharge ends of such retorts for rotation in a furnace. For instance, because the discharge end should be located within the furnace to provide improved quenching of the discharged workpieces, it is impractical to provide an entire support assembly, including a bearing or roller, inside the furnace, due to the adverse affect that the furnace atmosphere would have on the operating life of the bearing or roller.

Open-ended rotary retorts have been developed which are adapted for support externally of a furnace. For instance, Smith et al. U.S. Pat. Nos. 4,025,297 and 4,069,007 disclose a rotary retort furnace in which a retort is supported for rotation at only one end outside of the furnace, so that the retort is cantilevered into the furnace. The cantilevered retort of the Smith et al. patents is, however, subject to droop and fatigue and, therefore, undesirable.

In Heyer et al. U.S. Pat. No. 3,441,257 and Mesher et al. U.S. Pat. No. 3,927,959, there is disclosed a heat treating furnace having a cylindrical open-ended retort mounted for rotation therein. The discharge end of the retort is provided with a cone-shaped apron, one end of which abuts against the discharge end of the retort. The other end of the apron protrudes radially through the furnace where it, and hence the discharge end of the retort, is rotatably supported by a plurality of rollers.

Such a support assembly for the discharge end of the retort is undesirable because it requires the use of a special sealing and cooling means which is subject to rapid wear and requires frequent lubrication and adjustment. In addition, the apron, which serves as both an atmosphere seal and a support, is subject to warping and cracking, thereby impairing the integrity of the atmosphere seal and, simultaneously, the smoothness of rotation of the retort. Furthermore, workpieces exiting from the discharge end of the retort are discharged through a relatively cold chute, as a result of the chute being isolated from the heating chamber of the furnace by the apron. Because the workpieces are discharged through a relatively cold chute before they enter a suitable quench media, the workpieces are subjected to a chilling effect which is deleterious to proper hardening prior to quenching.

In order to improve upon the apron and seal arrangement disclosed in the Heyer et al. and Mescher et al. patents, the assignee of the present application developed a heat treating furnace, described and illustrated in Shaefer et al. U.S. Pat. No. 3,836,324, having a rotary retort equipped with a circumferential collar which protrudes radially through the furnace intermediate the ends thereof and provides an enlarged heated discharge chamber from which the workpieces can be dropped directly into a quench media without the chilling effect which is produced by the retort of the Heyer et al. and Mescher et al. patents. Despite the substantial advantages of the collar and support assembly described and illustrated in the Shaefer et al. patent, the retort still suffers from some of the same problems and disadvantages as those summarized above in the foregoing discussion of the Heyer et al. and Mescher et al. patents.

SUMMARY OF THE INVENTION

One aspect of the present invention involves a new and improved discharge end structure for a rotary retort which is adapted for rotation within a furnace. In accordance with the improvement, the discharge end structure includes a casing, having a hollow interior and a pair of open ends. A transporting mechanism, such as a helical conveyor or flight, is disposed within the casing for rotation therewith. Rotation of the casing, and hence the transporting mechanism, causes workpieces to be transported though the casing from one end to the other end by the transporting mechanism. A supporting assembly, such as an axle, disposed within the casing cooperates with the transporting mechanism to support the casing for rotation about a longitudinal axis thereof. The provision of an open-ended discharge structure facilitates uniform and controlled discharge of the workpieces therefrom after their transport through the casing.

In one embodiment, the casing is a secondary casing section attached in end-to-end fashion to a primary casing section to form a complete retort casing. The primary casing section may be a first cylindrical member having a hollow interior which houses a first helical flight. The secondary casing section may be a second cylindrical member having a hollow interior which a third cylindrical member arranged in coaxial relationship with the second cylindrical member and a second helical flight interposed between the second and third cylindrical members and fixedly connected thereto. When the first and second cylindrical members are connected together in end-to-end fashion, the first and second helical flights are cooperatively positioned adjacent each other for transporting workpieces through the retort casing upon the rotation thereof.

The third cylindrical member or an extension thereof may extend axially beyond the free end of the second cylindrical member and through an adjacent axial end of the furnace, so that the secondary casing section can be supported for rotation in the furnace by a suitable bearing assembly positioned externally of the furnace adjacent an axial end thereof. Inasmuch as the third cylindrical member has a diameter which can be much less than the diameter of the retort casing, only a relatively small sealing assembly is required in the adjacent axial end of the furnace to seal the interior of the furnace from the outside atmosphere. Also, the diameter of the third cylindrical member can be made so as to match the diameter of the small-diameter portion of a bell-shaped discharge end structure, whereby a retort provided with the discharge end structure of the present invention may be retro-fitted in a furnace equipped originally with a retort having a bell-shaped discharge end.

The radially innermost portion of the second helical flight, which is disposed in the interior of the second cylindrical member, has a thickness which is equal to or greater than the thickness of the radially outermost portion of the second helical flight. Inasmuch as the second helical flight functions as a support for the second cylindrical member and the radially innermost portion of the second helical flight is subjected to the greatest support forces, making the radially innermost portion of the second helical flight thicker than the radially outermost portion of the second helical flight advantageously strengthens the second helical flight, and hence the discharge end structure, without affecting the conveying function of the second helical flight.

Another aspect of the present invention involves a method of manufacturing the discharge end structure by which the second helical flight is formed monolithically with the second and third cylindrical members. Forming the discharge end structure as an integrated and assembled unit avoids having to weld the second helical flight to either or both of the second and third cylindrical members.

Regardless of how the discharge end structure is formed, the first and second helical flights must be welded together from the interiors of the first and second cylindrical members. Access to the interiors of the first and second cylindrical members may be provided by forming welding windows therein.

BRIEF DESCRIPTION OF THE DRAWING

For a more complete understanding of the present invention, reference may be had to the following description of any exemplary embodiment taken in conjunction with accompanying figures of the drawing, in which.

DESCRIPTION OF AN EXEMPLARY EMBODIMENT

Figures 1, 2:
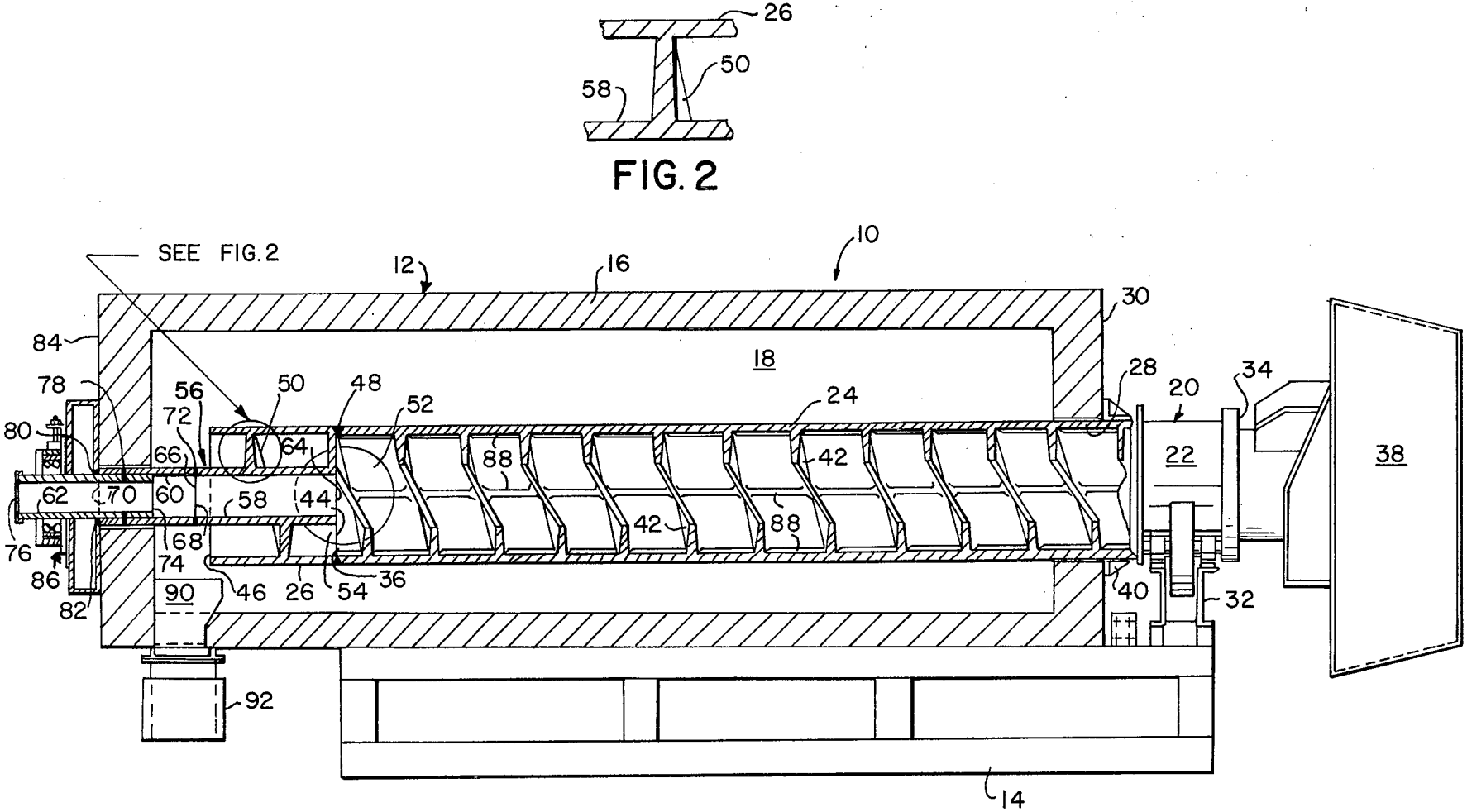
FIG. 1 is a longitudinal cross-sectional view of a rotary retort furnace constructed in accordance with the present invention.
FIG. 2 is an enlarged longitudinal cross-sectional view of the circled portion of the rotary retort furnace shown in FIG. 1.

With reference to FIGS. 1 and 2, there is shown a rotary retort furnace 10 including a housing 12 which is supported on a base 14. The housing 12 includes a layer 16 of a refractory material. The interior of the housing 12 defines a heating chamber 18 having either electric or gas heating means (not shown) to establish the required temperature in the heating chamber 18.

A retort 20 is mounted for rotation in the heating chamber 18. The retort 20 includes a casing 22 formed by a primary casing section 24 and a secondary casing section 26.

The primary casing section 24 extends through an opening 28 in an end 30 of the housing 12. A bearing assembly 32 mounted externally of the housing 12 on the base 14 supports one end of the retort 20 for rotation with respect to the housing 12. The primary casing section 24 has pair of substantially open ends 34, 36. The end 34 of the primary casing section 24 is positioned externally of the housing 12 adjacent to a work feeding station 38. The end 36 of the primary casing section 24 is positioned internally of the housing 12 in the heating chamber 18. A sealing assembly 40 positioned adjacent the opening 28 seals off the heating chamber 18 from the outside atmosphere.

A helical flight 42 extends generally radially inwardly from the primary casing section 24 along substantially its entire length. The radially innermost portion of the helical flight 42, i.e., the portion remote from the primary casing section 24, has a thickness which is equal to or less than the thickness of the radially outermost portion of the helical flight 42, i.e., the portion adjacent the primary casing section 24. Although the primary casing section 24 and the helical flight 42 are shown, in FIG. 1, as being formed monolithically by, for example, a suitable casting process, they may be manufactured separately and subsequently attached, for instance, by welding.

The secondary casing section 26, which has a pair of open ends 44, 46, is positioned in the heating chamber 18 adjacent the primary casing section 24 and a coaxial relationship therewith. The end 44 of the secondary casing section 26 is fixedly attached to the end 36 of the primary casing section 24 by a continuous circumferential weld 48. A helical flight 50 extends generally radially inwardly from the secondary casing section 26 along substantially its entire length. Access doors 52, 54 are formed in the primary casing section 24 and the secondary casing section 26, respectively, to provide access to the interiors of the primary casing section 24 and the secondary casing section 26 for welding or otherwise attaching the helical flights 42, 50 so as to form a continuous spiral along substantially the entire length of the casing 22.

The radially innermost portion of the helical flight 50, i.e., the portion remote from the secondary casing section 26, has a thickness which is equal to or greater than the thickness of the radially outermost portion of the helical flight 50, i.e., the portion adjacent the secondary casing section 26. Although the secondary casing section 26 and the helical flight 50 are shown, in FIG. 1, as being formed monolithically by, for example, a suitable casting process, they may be manufactured separately and subsequently attached, for instance, by welding.

The radially innermost portion of the helical flight 50 is fixedly attached to an axle assembly 56, which cooperates with the helical flight 50 to support the other end of the retort 20 during its rotation. The axle assembly 56, in this embodiment, includes three tubular shafts 58, 60, 62. Other shaft combinations are, of course, possible.

For instance, the axle assembly 56 may be made from a single shaft, rather than a plurality of shafts.

The tubular shaft 58, which has a pair of open ends 64, 66, is disposed within the secondary casing section 26 and formed monolithically with the helical flight 50 by, for example, a suitable casting process, although the tubular shaft 58 and the helical flight 50 could be manufactured separately and subsequently attached, for instance, by welding. The end 64 of the tubular shaft 58 lies in the same vertical plane as the end 44 of the secondary casing section 26. The end 66 of the tubular shaft 58 extends axially beyond the end 46 of the secondary casing 26. The tubular shaft 58 is connected to the tubular shaft 60, which has a pair of open ends 68, 70, by a continuous circumferential weld 72, which joins the end 66 of the tubular shaft 58 to the end 68 of the tubular shaft 60.

The tubular shaft 62, which has a pair of open ends 74, 76, is fixedly attached to the tubular shaft 60 by plug welds 78 and a continuous circumferential weld 80. The end 74 of the tubular shaft 62 is positioned within the tubular shaft 60. The end 76 of the tubular shaft 66 extends axially beyond the end 70 of the tubular shaft 60 and through an opening 82 in an end 84 of the housing 12. A sealed and water-cooled bearing assembly 86 positioned externally of the housing 12 adjacent the end 84 thereof supports the tubular shaft 62, and hence the axle assembly 56, for rotation with respect to the housing 12 and seals the heating chamber 18 from the outside atmosphere.

In operation, workpieces are fed from the feeding station 38 into the primary casing section 24 through the end 34 thereof. When the primary casing section 24 is rotated by a suitable drive device (not shown), the workpieces are transported lengthwise through the primary casing section 24 by the helical blight 42. Tumbler bars 88, which extend generally radially inwardly from the primary casing section 24 between adjacent turns of the helical flight 42, provide a more complete exposure of the workpieces to the protective atmosphere inside the retort 20 as they are transported through the primary casing section 24. After reaching the end 36 of the primary casing section 24, the workpieces pass into the secondary casing section 26. The rotation of the secondary casing section 26 causes the workpieces to continue to be transported lengthwise through the secondary casing section 26 by the helical flight 50. When the workpieces reach the end 46 of the secondary casing section 26, they drop down into an inner discharge chute 90 positioned in the heating chamber 18 and leading into an outer discharge chute 92 positioned externally of the housing 12 and sealed by the liquid level in an underlying quench tank (not shown).

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

What is claimed is:

1. A discharge end structure for a rotary retort, comprising a rotatable casing, having a hollow interior and a pair of open ends; transporting means disposed within said casing and rotatable therewith for transporting workpieces through said casing from one end to the other end in response to the rotation of said casing; and supporting means disposed within said casing and directly cooperating with said transporting means for supporting said casing for rotation about a longitudinal axis thereof extending from said one end to said other end, whereby workpieces are dischargeable directly from said other end of said casing.

2. A discharge end structure according to claim 1, wherein said casing is a first cylindrical member, having an outer circumferential surface and an inner circumferential surface; said supporting means is a second cylindrical member disposed within said first cylindrical member in coaxial relationship therewith, said second cylindrical member having an outer circumferential surface; and said transporting means is helical flight disposed within said first cylindrical member between said first cylindrical member and second cylindrical member, said helical flight being fixedly connected to said first and second cylindrical members.

3. A discharge end structure according to claim 2, wherein said helical flight extends radially inwardly from said inner circumferential surface of said first cylindrical member to said outer circumferential surface of said cylindrical member.

4. A discharge end structure according to claim 3, wherein the radially innermost portion of said helical flight has a thickness which is equal to or greater than the thickness of the radially outermost portion of said helical flight.

5. A discharge end structure according to claim 2, wherein said helical flight is formed monolithically with said first and second cylindrical members.

6. A rotary retort comprising, a rotatable casing having a first end and a second end, said second end being open; transporting means disposed within said casing and rotatable therewith for transporting workpieces through said casing from said first end to said second end; and supporting means extending into said second end of said casing and directly cooperating with said transporting means for supporting said casing for rotation about a longitudinal axis thereof extending from said first end to said second end, whereby workpieces are dischargeable directly from said second end of said casing.

7. A rotary retort according to claim 6, wherein said casing includes a first casing section, having a hollow interior, an open end and a first helical flight disposed within said first casing section, and a second casing section, forming a discharge end structure and having a hollow interior, a pair of open ends, an axle disposed within said second casing section in coaxial relationship therewith and a second helical flight disposed within said second casing section between said second casing section and said axle, said second helical flight being cooperatively positioned adjacent said first helical flight to form said transporting means and cooperating with said axle to support said second casing section for rotation about a longitudinal axis thereof extending from one end of said second casing section to the other end thereof, said one end of said second casing section being attached to said open end of said first casing section in coaxial relationship therewith.

8. A rotary retort according to claim 7, wherein said first casing section is a first cylindrical member, having an outer circumferential surface and an inner circumferential surface; said second casing section is a second cylindrical member, having an outer circumferential surface and an inner circumferential surface; and said axle is a third cylindrical member, having an outer circumferential surface.

9. A rotary retort according to claim 8, wherein said first helical flight extends radially inwardly from said inner circumferential surface of said first cylindrical member.

10. A rotary retort according to claim 9, wherein said first helical flight is formed monolithically with said first cylindrical member.

11. A rotary retort according to claim 9, wherein the radially innermost portion of said first helical flight has a thickness which is equal to or less than the thickness of the radially outermost portion of said first helical flight.

12. A rotary retort according to claim 11, wherein said second helical flight extends radially inwardly from said inner circumferential surface of said second cylindrical member to said outer circumferential surface of said third cylindrical member.

13. A rotary retort according to claim 12, wherein the radially innermost portion of said second helical flight has a thickness which is equal to or greater than the thickness of the radially outermost portion of said second helical flight.

14. A rotary retort according to claim 12, wherein said second helical flight is formed monolithically with said second and third cylindrical members.

15. A rotary retort according to claim 7, wherein said retort is mounted for rotation within a furnace, said other end of said second casing section being positioned within said furnace.

16. In combination, a furnace having a housing, first bearing means positioned externally of said housing adjacent one end thereof, and second bearing means positioned externally of said housing adjacent the opposite end thereof; and a retort mounted for rotation relative to said furnace, said retort including a first cylindrical member, having a hollow interior, an outer circumferential surface, an inner circumferential surface and a pair of open ends, one end of said first cylindrical member being disposed within said furnace and the other end of said first cylindrical member being disposed externally of said furnace and supported for rotation by said first bearing means, a first helical flight disposed within said first cylindrical member, a second cylindrical member disposed within said furnace and having an outer circumferential surface, an inner circumferential surface, a hollow interior, and a pair of open ends, one end of said second cylindrical member being attached to said one end of said first cylindrical member in coaxial relationship therewith, a third cylindrical member disposed within said second cylindrical member in coaxial relationship therewith, said third cylindrical member being supported for rotation by said second bearing means and having an outer circumferential surface, a second helical flight disposed within said second cylindrical member between said second cylindrical member and said third cylindrical member, said second helical flight being cooperatively positioned adjacent said first helical flight and cooperating with said third cylindrical member to support said second cylindrical member for rotation about a longitudinal axis thereof extending from said one end of said second cylindrical member to the other end thereof.

17. A combination according to claim 16, wherein said first helical flight extends radially inwardly from said inner circumferential surface of said first cylindrical member.

18. A combination according to claim 17, wherein said first helical flight is formed monolithically with said first cylindrical member.

19. A combination according to claim 17, wherein the radially innermost portion of said first helical flight has a thickness which is equal to or less than the thickness of the radially outermost portion of said first helical flight.

20. A combination according to claim 19, wherein said second helical flight extends radially inwardly from said inner circumferential surface of said second cylindrical member to said outer circumferential surface of said third cylindrical member.

21. A combination according to claim 20, wherein the radially innermost portion of said second helical flight has a thickness which is equal to or greater than the thickness of the radially outermost portion of said second helical flight.

22. A combination according to claim 20, wherein said second helical flight is formed monolithically with said second and third cylindrical members.

23. A method of making a rotary retort discharge end structure including a first cylindrical member, having a hollow interior and a pair of open ends, a second cylindrical member disposed within said first cylindrical member in coaxial relationship therewith, and a helical flight disposed within said first cylindrical member between said first cylindrical member and said second cylindrical member, said helical flight being fixedly connected to said first and second cylindrical members, comprising the step of forming said helical flight monolithically with said first and second cylindrical members.

24. A method according to claim 23, wherein said first and second cylindrical members are formed monolithically with said helical flight by casting said first cylindrical member, said second cylindrical member and said helical flight as a single unit.

25. A method of making a rotary retort, including a first cylindrical member having a hollow interior, a first helical flight disposed therein and an open end, comprising the steps of providing a discharge end structure including a second cylindrical member, having a hollow interior and a pair of open ends, a third cylindrical member disposed within said second cylindrical member in coaxial relationship therewith, and a second helical flight disposed within said second cylindrical member between said second cylindrical member and said third cylindrical member, said second helical flight being fixedly connected to said second and third cylindrical members; welding one end of said second cylindrical member to said open end of said first cylindrical member; providing access to said interiors of said first and second cylindrical members; and welding said first helical flight to said second helical flight from said interiors of said first and second cylindrical members.

26. A method according to claim 25, wherein access is provided to said interiors of said first and second cylindrical members by providing a welding window in said first and second cylindrical members.

27. A method according to claim 25, wherein said second helical flight is formed monolithically with said third cylindrical member.

28. A method according to claim 27, wherein said second helical flight is welded to said second cylindrical member from said interior of said second cylindrical member.

29. A method according to claim 28, wherein access is provided to said interior of said second cylindrical member by providing a welding window in said second cylindrical member.

30. A method according to claim 27, wherein said second helical flight is formed monolithically with said second cylindrical member.

31. A method according to claim 30, wherein said second and third cylindrical members are formed monolithically with said second helical flight by casting said second cylindrical member, said third cylindrical member and said second helical flight as a single unit.

* * * * *